US008201711B2

(12) United States Patent
Tsai

(10) Patent No.: US 8,201,711 B2
(45) Date of Patent: Jun. 19, 2012

(54) MIXING DEVICE FOR INDIVIDUAL HYDRATION UNIT

(75) Inventor: Ho Chan Tsai, Taipei Hsien (TW)

(73) Assignee: Chien-Ping Lien, Taipei Hsien (TW)

( * ) Notice: Subject to any disclaimer, the term of this patent is extended or adjusted under 35 U.S.C. 154(b) by 402 days.

(21) Appl. No.: 12/683,009

(22) Filed: Jan. 6, 2010

(65) Prior Publication Data

US 2011/0162740 A1 Jul. 7, 2011

(51) Int. Cl.
*B67D 7/84* (2010.01)

(52) U.S. Cl. ... 222/175; 251/209; 251/904; 137/625.47; 137/614.18; 222/144.5

(58) Field of Classification Search ..... 137/605, 137/607, 625.47, 614.2, 264, 625.4–625.42, 137/614.18; 251/209, 311, 904; 220/703, 220/705, 710; 222/94, 175, 144.5; 224/148.1–148.7; 383/38, 906
See application file for complete search history.

(56) References Cited

U.S. PATENT DOCUMENTS

| | | | | |
|---|---|---|---|---|
| 3,459,220 | A * | 8/1969 | Morse | 137/605 |
| 6,497,348 | B2 * | 12/2002 | Forsman et al. | 224/148.2 |
| 6,749,090 | B2 * | 6/2004 | Bailey | 222/175 |
| 7,487,888 | B1 * | 2/2009 | Pierre, Jr. | 222/144.5 |
| 2004/0118942 | A1 * | 6/2004 | Courtney | 239/302 |
| 2009/0152298 | A1 * | 6/2009 | Woolfson et al. | 222/144.5 |

* cited by examiner

*Primary Examiner* — John Rivell
*Assistant Examiner* — Ian Paquette
(74) *Attorney, Agent, or Firm* — Bacon & Thomas, PLLC

(57) ABSTRACT

An individual hydration unit includes a bag having a first chamber and a second chamber, the first chamber is connected with a first hose and the second chamber is connected with a second hose. A regulator is connected to the first and second hoses and connected to a third hose. The regulator includes a cylindrical body which has a first passage, a second passage and a third passage. An operation rod is rotatably inserted in the body and includes two first paths, two second paths, a third path and two fourth paths. The first, second, third and fourth paths are in communication with each other. By rotating the operation rod, the first, second and third passages are controlled to be opened and/or closed so as to mix the liquids in the two chambers as desired. A connection assembly is attached to the body for convenience of carried.

4 Claims, 13 Drawing Sheets

MIXING DEVICE FOR INDIVIDUAL HYDRATION UNIT

FIELD OF THE INVENTION

The present invention relates to a mixing device, and more particularly, to a mixing device for individual hydration unit, two different liquids can be adjustably mixed before served by the user.

BACKGROUND OF THE INVENTION

A conventional mixing device for individual hydration unit generally includes a bag with two storage chambers in which two different liquids are received, a first hose and a second hose are connected with the two chambers and communicate with a "Y" shaped connector which is connected to a third hose. The first and second hoses each have a recessed regulator so as to regulate the volume through the hoses. The drawback is that the adjustment is complicated and not easy to control. Another conventional mixing device for individual hydration unit generally includes a bag with a box, and a mixing unit. There are two inlets defined in the top of the mixing unit, wherein a first inlet for introducing water to the bag, a second inlet for introducing material to the box. An outlet is connected with a mouthpiece. The water is mixed with the material in a space at least 5 ml and the mixture is served via the mouthpiece. By the specific arrangement, a desired mixture can be obtained and the operation is easy for the users. However, the user can only control the volume of the material rather than the volume of the water, so that the users cannot have the desired ratio of the mixture of the material and the water.

The present invention intends to provide a mixing device which can mix different liquids with multiple options of mixing ratio.

SUMMARY OF THE INVENTION

The present invention relates to an individual hydration unit and comprises a bag having a first chamber and a second chamber defined therein. The first chamber has a first outlet connected thereto which is connected to a first hose, and the second chamber has a second outlet connected thereto which is connected to a second hose. A regulator is connected to the first and second hoses and a third hose is connected to the regulator and located in opposite to the first and second hoses. A mouthpiece is connected to a distal end of the third hose. The regulator has a cylindrical body which has a first passage, a second passage and a third passage. A restriction ring is connected to an end of the body and an index is marked on an outside of the body. An operation rod is rotatably inserted in the body and a knob is connected to an end of the operation rod. A marker extends inward and radially from the knob and has a hook portion which is engaged with the restriction ring. Two first paths, two second paths, a third path and two fourth paths are defined through the operation rod. The first, second, third and fourth paths are in communication with each other. A connection assembly is attached to the body and includes a connection piece and a connection member, wherein the connection piece has a rectangular protrusion extending from a mediate portion thereof. An adjustment slit is defined in the protrusion. The connection member has a rectangular engaging hole which has an adjustment slot. The protrusion is engaged with the engaging hole.

An alternative embodiment of the present invention provides the operation rod that includes first slot and a second slot defined therein, wherein the first and second slots are wedge-shaped slots and orientated in opposite directions. A third slot is defined in the operation rod and located in opposite to the first and second slots. The third slot is located corresponding to the third passage of the body. A curved engaging member has two holes and two one-direction valves are engaged with the two holes. A groove is defined in an end of the engaging member and a seal ring is engaged with the groove. The engaging member is received in the operation rod so that when rotating the operation rod, the third slot communicates with the third passage, the first and second slots communicate with the first and second passages in opposite proportional change.

The primary object of the present invention is to provide a mixing unit for an individual hydration device which is attached to the user's belt or the backpack. By rotating the operation rod, the two different liquids can be served in desired mixture ratio.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
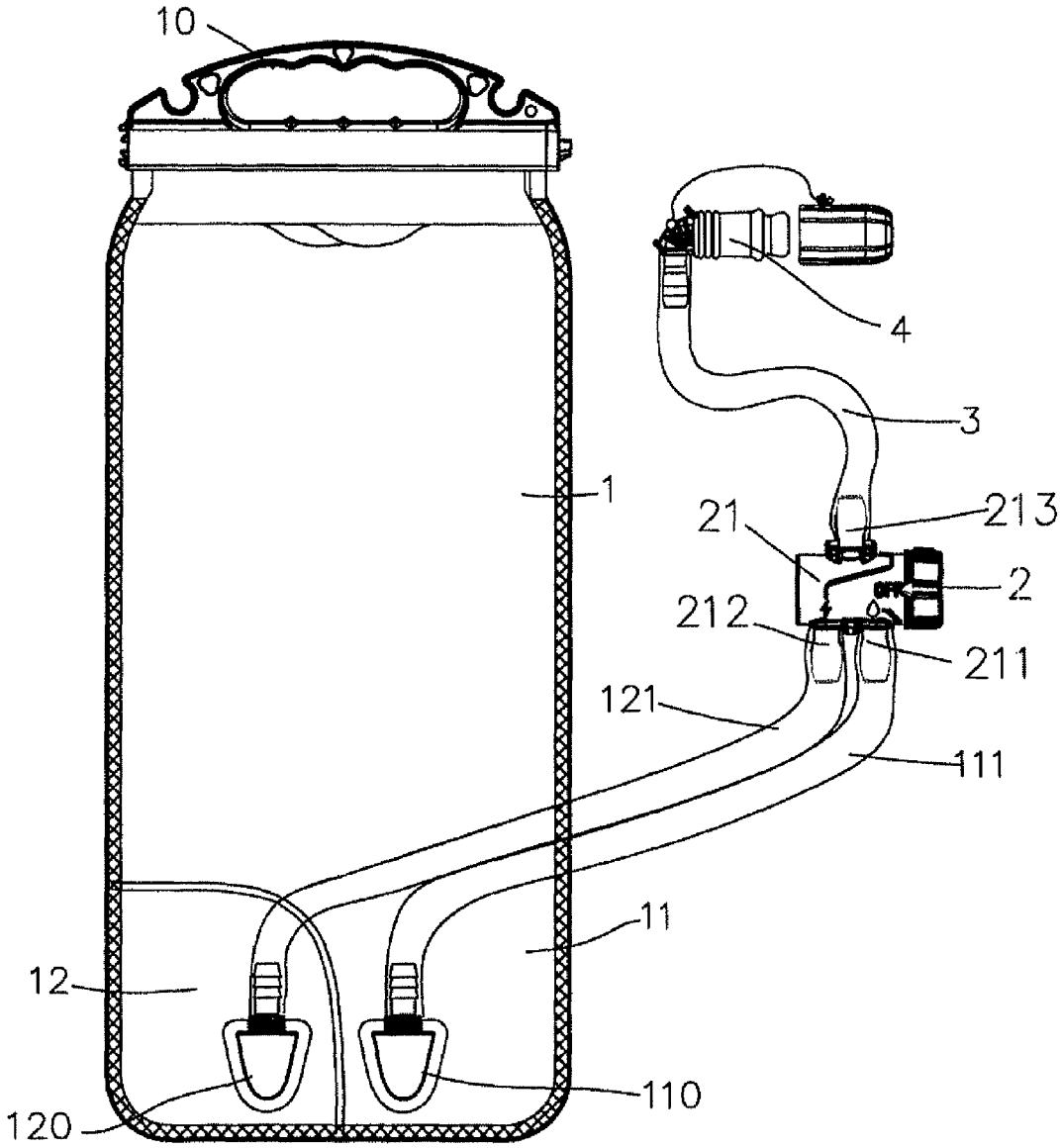
FIG. 1 is a perspective view to show the mixing unit and the individual hydration device of the present invention.
Figure 2:
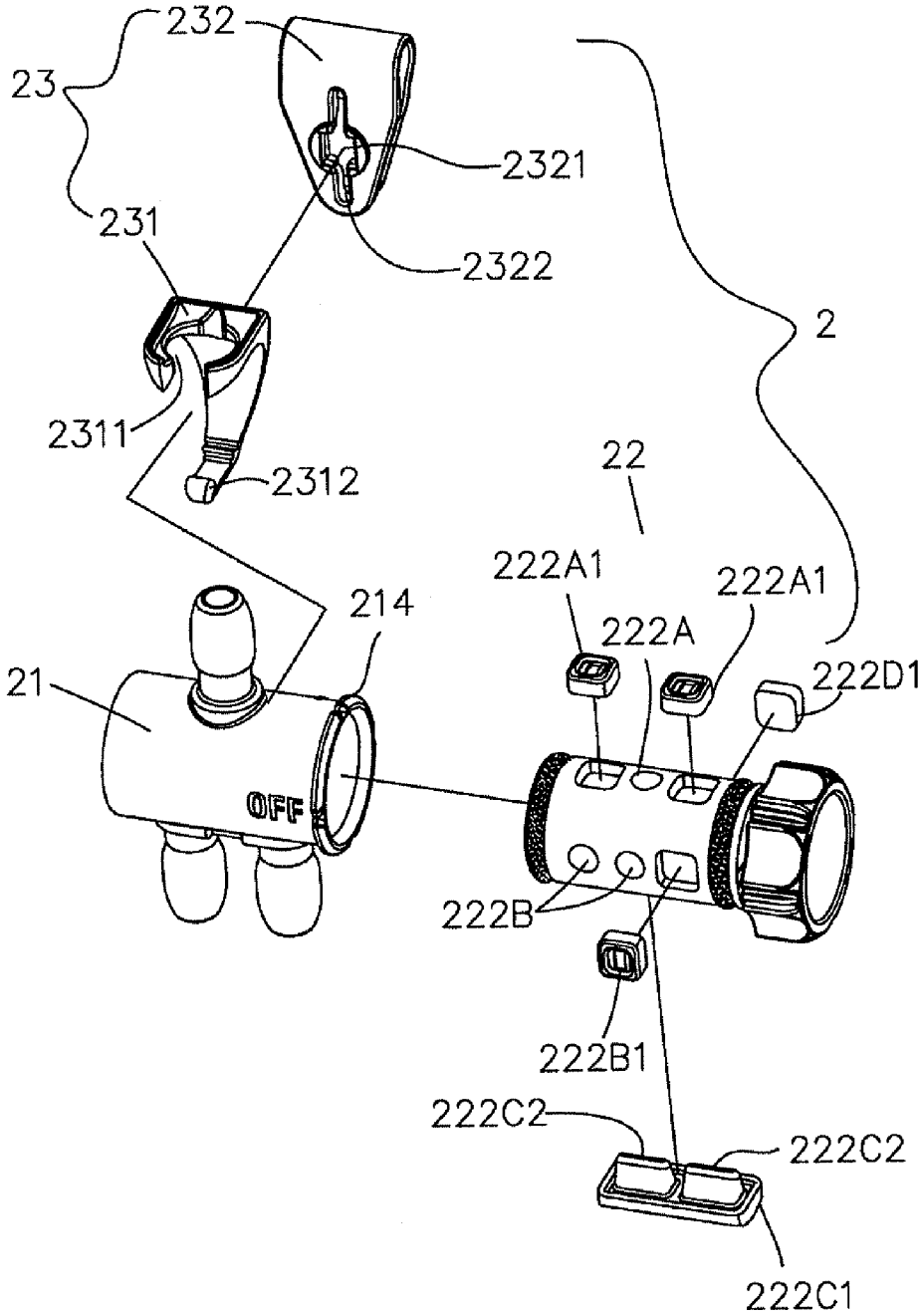
FIG. 2 is an exploded view to show the mixing unit of the present invention.
Figure 3:
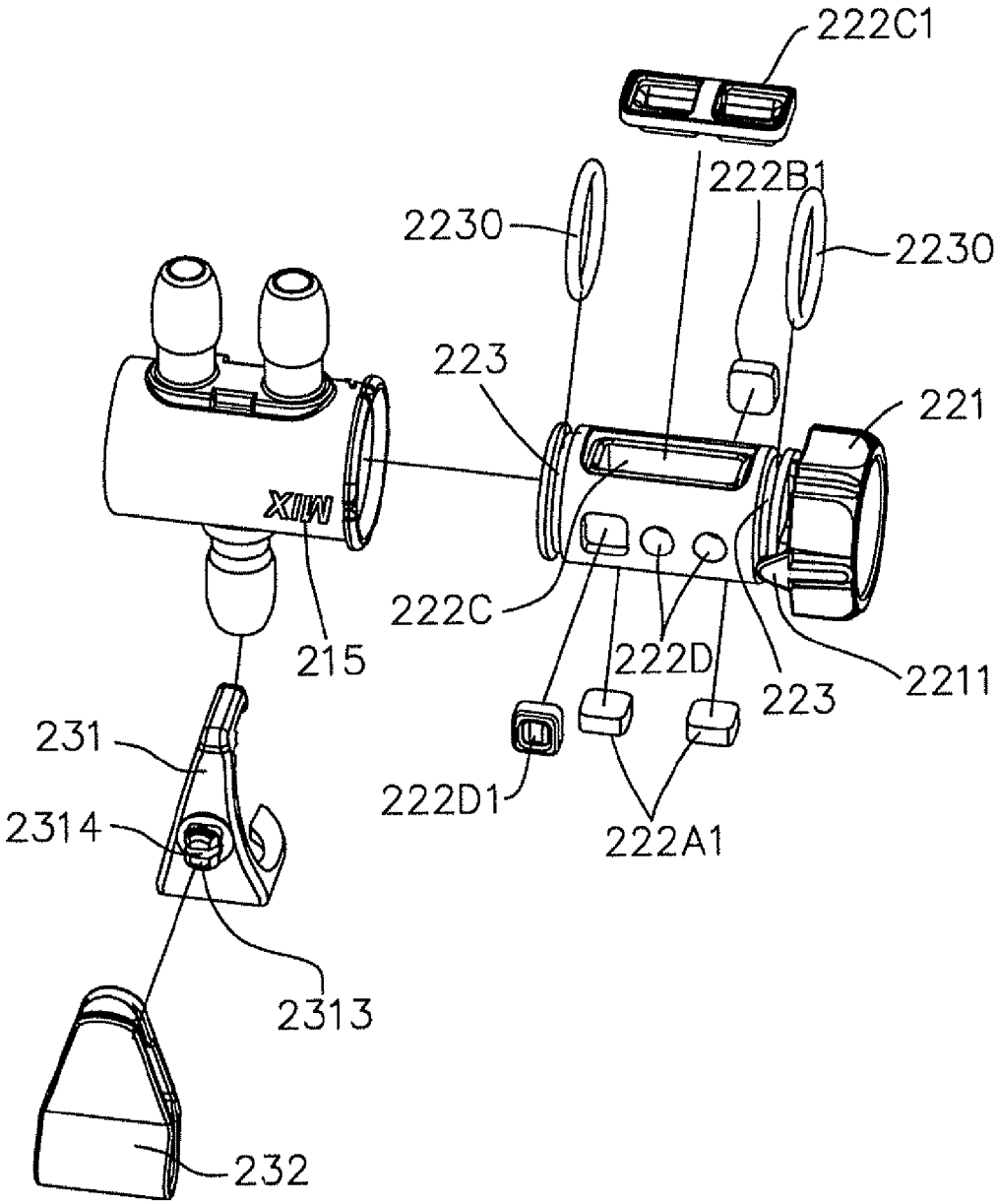
FIG. 3 is another exploded view to show the mixing unit of the present invention.

Referring to FIGS. 1 to 3, the individual hydration device of the present invention comprises a bag 1 which has an open top to which a handle 10 is connected and the bag 1 includes a first chamber 11 and a second chamber 12 defined therein. The first chamber 11 is located at the front portion of the bag 1 and the second chamber 12 is located at the rear portion of the bag 1. The first chamber 11 has a first outlet 110 connected thereto and the second chamber 12 has a second outlet 120 connected thereto. The first outlet 110 is connected with a first hose 111 and the second outlet 120 is connected with a second hose 121. A regulator 2 is connected to the first and second hoses 111, 121 and a third hose 3 is connected to the regulator 2 and located in opposite to the first and second hoses 111, 121. The body 21 has a first connection tube 211 and a second connection tube 211 extending therefrom, wherein the first connection tube 211 is connected to the first hose 111 and the second connection tube 212 is connected to the second hose 121. The body 21 further has a third connection tube 213 which is connected to the third hose 3. A mouthpiece 4 is connected to a distal end of the third hose 3.

The regulator 2 includes a cylindrical body 21, an operation rod 22 and a connection assembly 23. The body 21 has a restriction ring 214 is connected to an end of the body 21 and of indexes 215 are marked on an outside of the body 21. An operation rod 22 is rotatably inserted in the body 21 and a knob 221 is connected to an end of the operation rod 22. A marker 2211 extends inward and radially from the knob 221 and has a hook portion 22111 which is engaged with the restriction ring 214. Two first paths 222A, two second paths 222B, a third path 222C and two fourth paths 222D are defined through the operation rod 22 and located at four directions such as 0 degree position, 90 degree position, 180 degree position and 270 degree position. The first, second, third and fourth paths are in communication with each other. A first, second and fourth pads 222A1, 222B1, 222D1 are respectively engaged with the first, second and fourth paths 222A, 222B, 222D, while the third path 222C is engaged with a third pad 222C1 which includes a one-direction valve with a slits 222C2. There are two separated openings defined in the third pad 222C1. The operation rod 22 has a groove 223 defined in an end thereof and a seal ring 2230 is engaged with the groove 223.

The connection assembly 23 is attached to the body and includes a connection piece 231 and a connection member 232, wherein the connection piece 231 has a clip member 2311 which is fixed to the root portion of the third connection tube 213 and the other end has a hook 2312 engaged between the first connection tube 211 and the second connection tube 212. The connection piece 231 includes a rectangular protrusion 2313 protruding from a mediate portion thereof and an adjustment slit 2314 is defined in the protrusion 2313. The connection member 232 has a rectangular engaging hole 2321 which has an adjustment slot 2322. The protrusion 2313 engaged with the engaging hole 2321.

Figure 4:
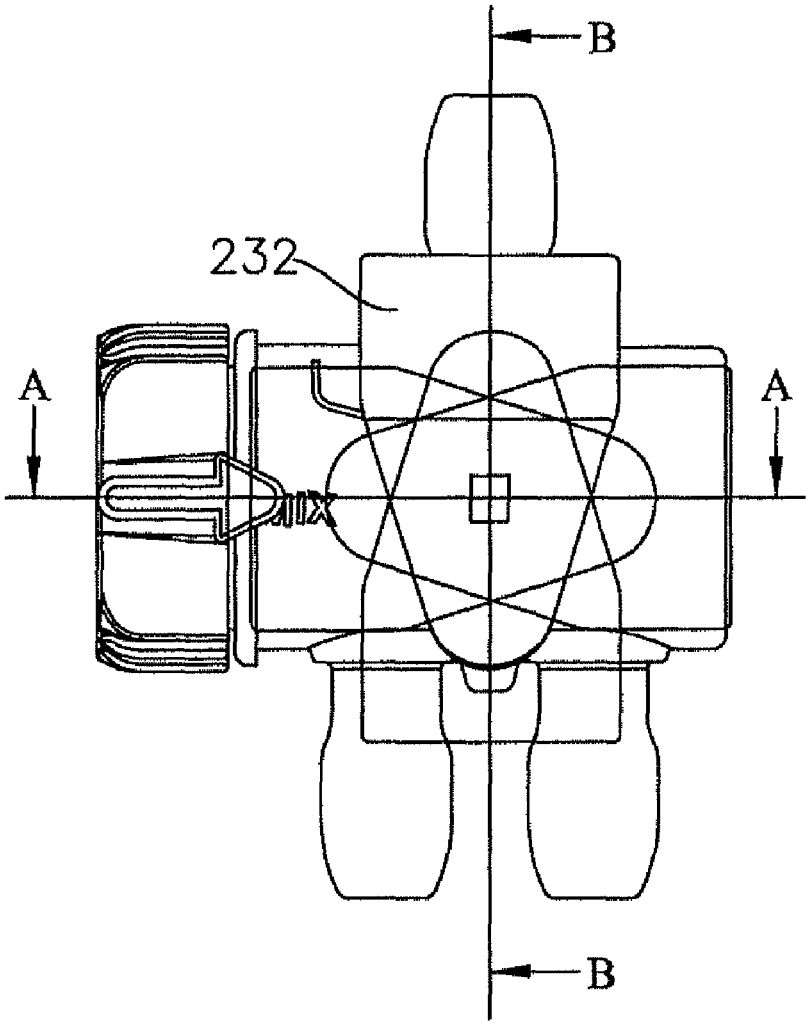
FIG. 4 shows the individual hydration device with the connection assembly connected thereto which is rotated in two different positions.
Figure 5:
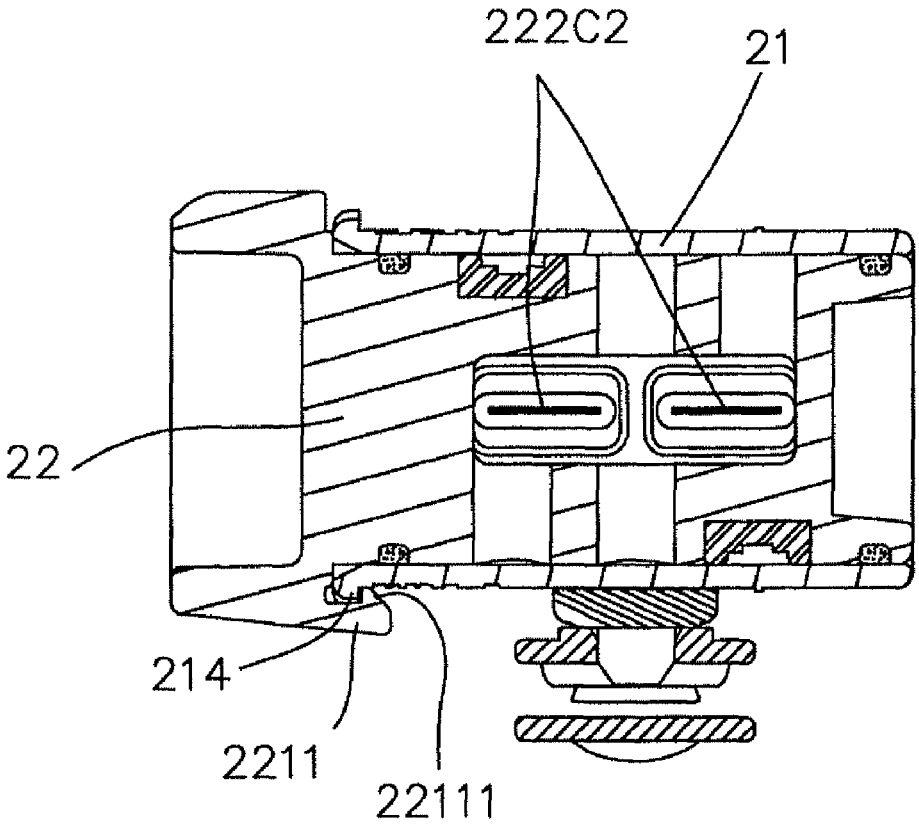
FIG. 5 is a cross sectional, view taken along line A-A in FIG. 4.
Figure 6:
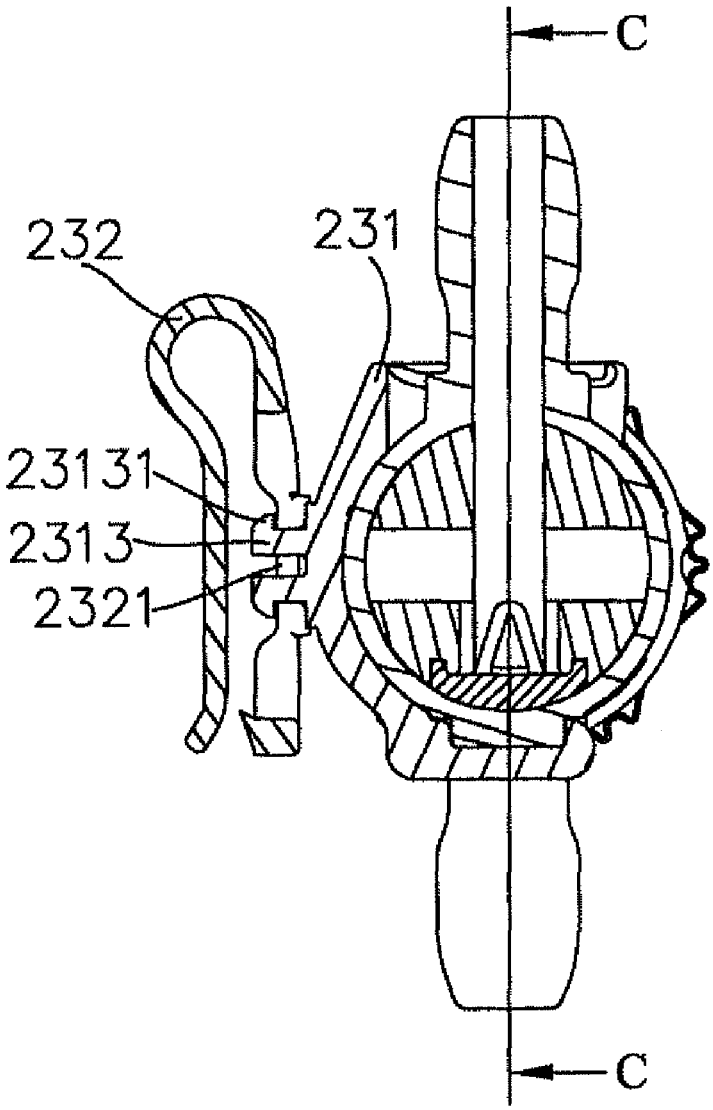
FIG. 6 is a cross sectional, view taken along line B-B in FIG. 4.

As shown in FIGS. 4 to 6, the protrusion 2313 includes two blocks 23131 which are engaged within the connection member 232. There are four positions by rotating the relative positions between the connection member 232 and the connection piece 231.

As shown in FIG. 5, the marker 2211 includes the hook portion 22111 which is engaged with the restriction ring 214 when the operation rod 22 is inserted into the body 21.

Figure 7:
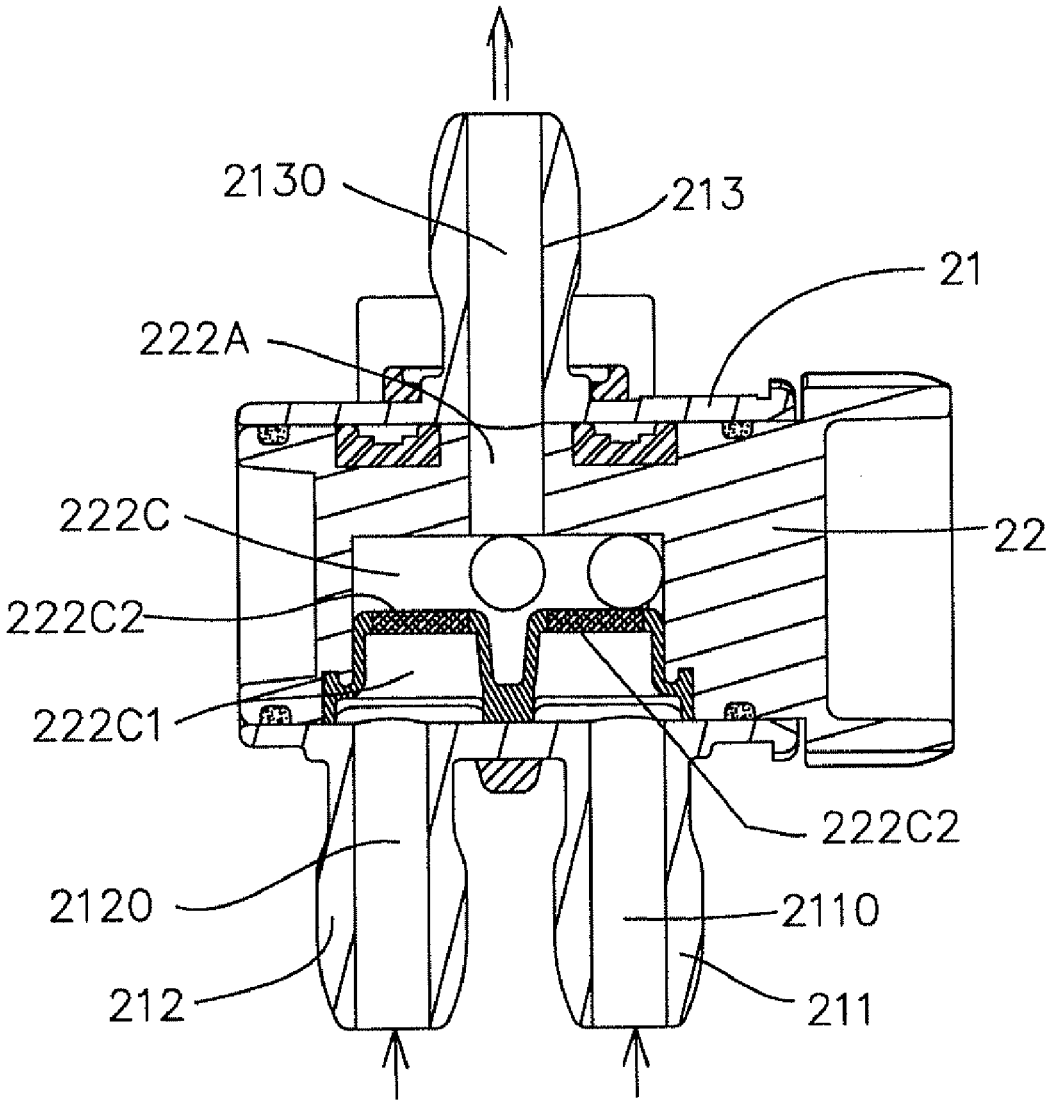
FIG. 7 is a cross sectional, view taken along line C-C in FIG. 6, wherein the first and second passages are in communication with the third passage.

As shown in FIG. 7, the first connection tube 211 has a first passage 2110 defined therethrough, the second connection tube 212 has a second passage 2120 defined therethrough and the third connection tube 213 has a third passage 2130 defined therethrough. When the marker 2211 is rotated to point the index 215 "MIX", the third passage 2130 communicates with the first path 222A. The third path 222C communicates with the first and second passages 2110, 2120. When the user sucks via the mouthpiece 4, the suction force opens the slits 222C2 of the third pad 222C1 so that the liquids in the first and second chambers 11, 12 are sucked out from the mouthpiece 4.

Figure 8:
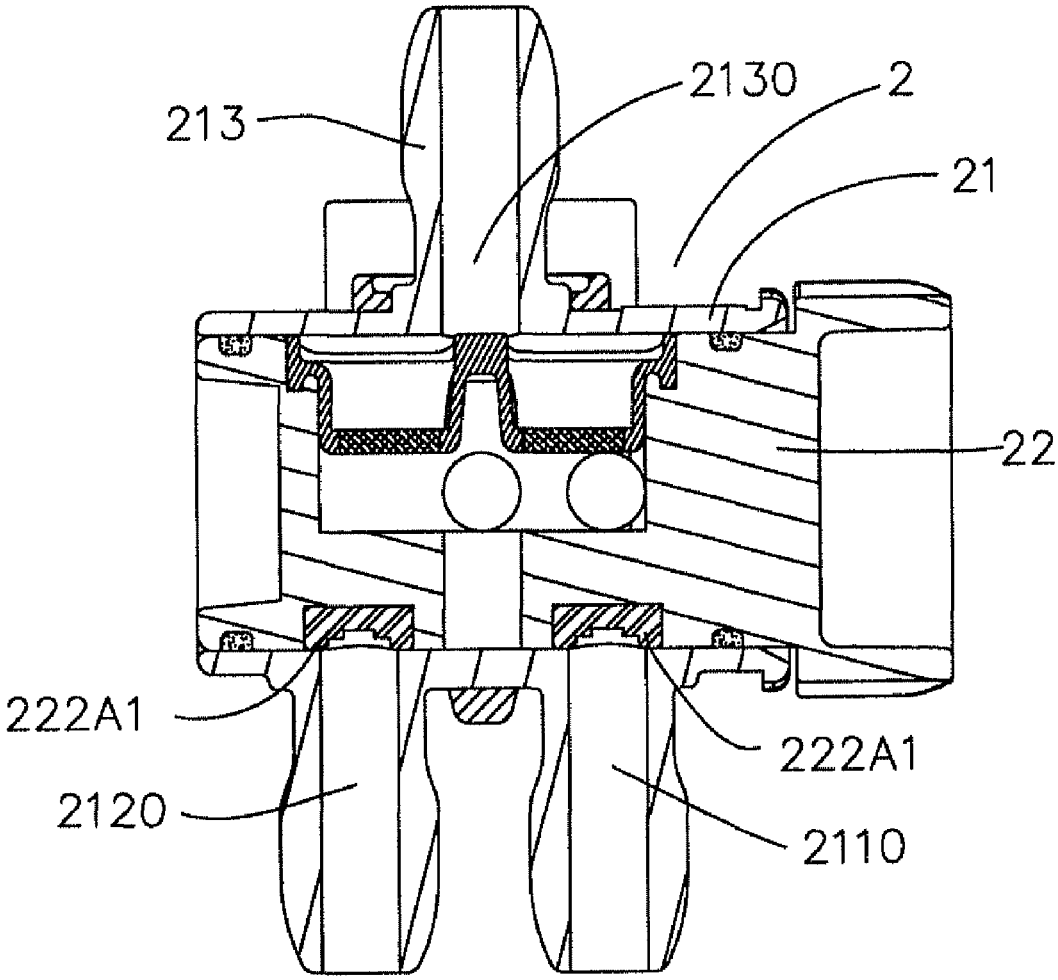
FIG. 8 is a cross sectional, view taken along line C-C in FIG. 6, wherein both of the first and second passages are not in communication with the third passage.

As shown in FIG. 8, when the knob 221 on the operation rod 22 is rotated to point the marker 2211 to the index 215 "OFF", the first and second passages 2110, 2120 are blocked by the first pads 222A1, and the third path 222C are isolated so that the regulator 2 is now in closed status. The liquids in the first and second chambers 11, 12 are not able to be served.

Figure 9:
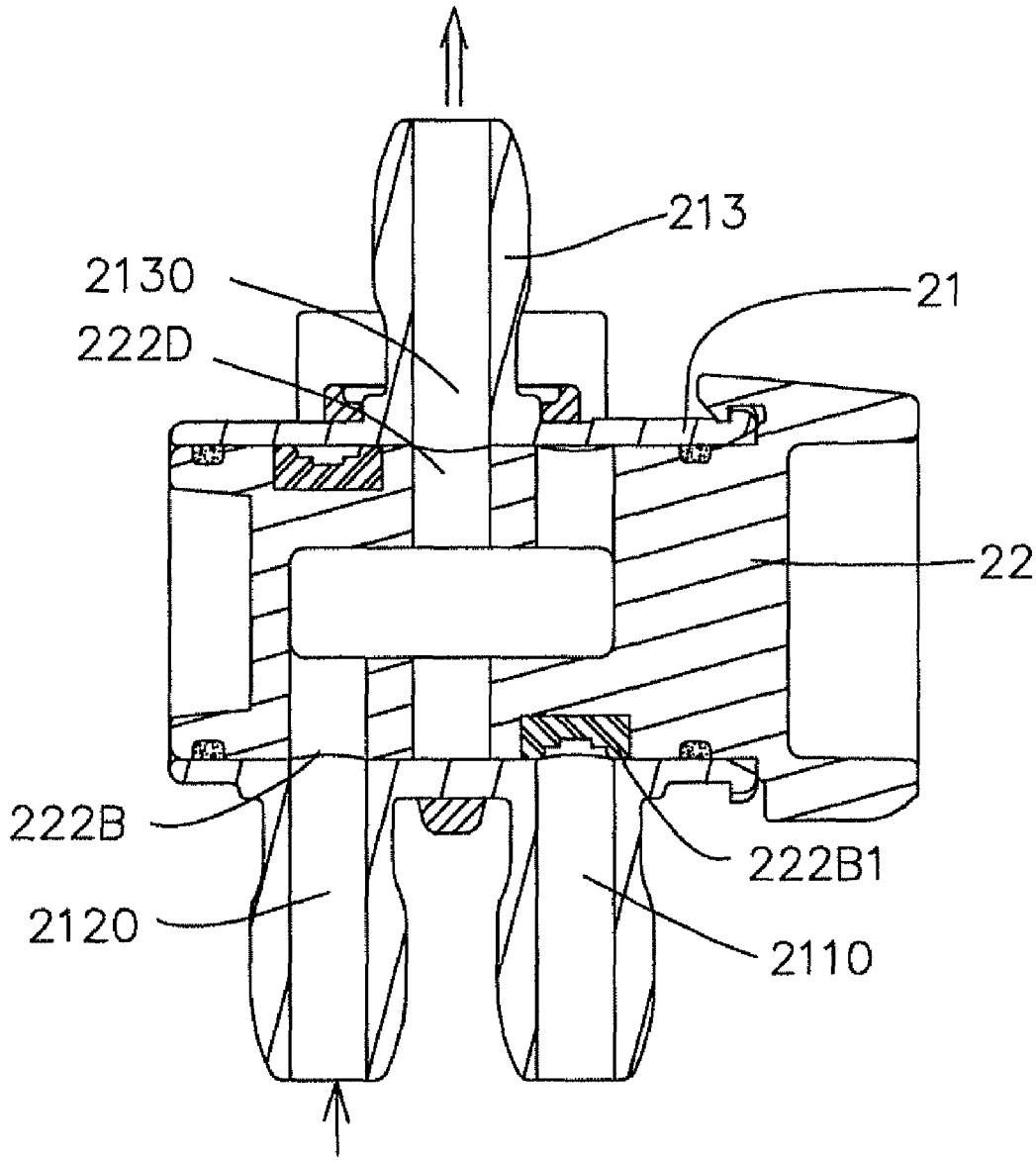
FIG. 9 is a cross sectional, view taken along line C-C in FIG. 6, wherein only the second passage is in communication with the third passage.

As shown in FIG. 9, when the operation rod 22 is rotated to communicate the second passage 2120 with the second path 222B, the first passage 2110 is sealed by the second pad 222B1 so that the third passage 2130 communicates with the fourth path 222D, and the liquid in the second chamber 12 is able to be sucked out from the mouthpiece 4.

Figure 10:
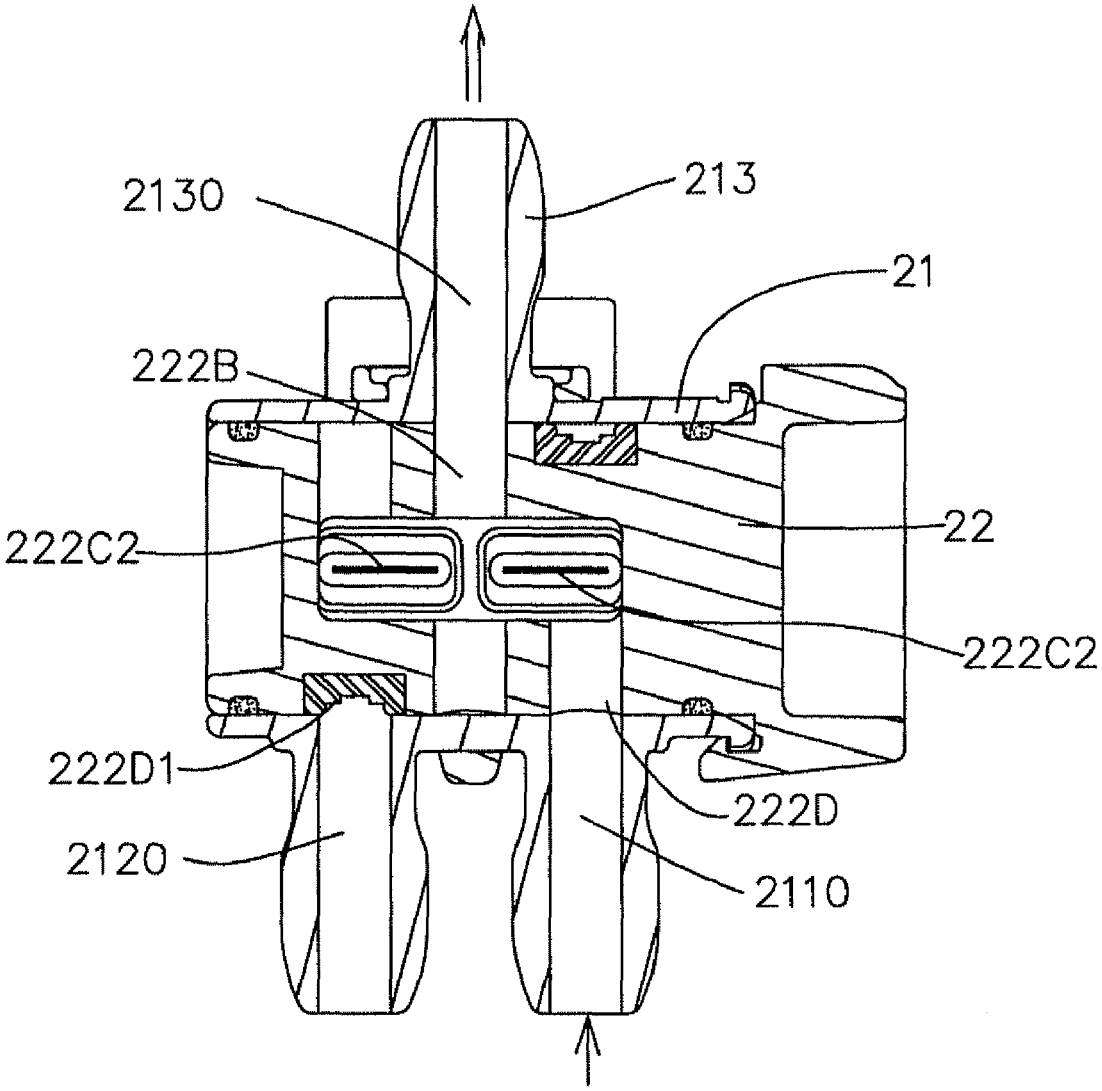
FIG. 10 is a cross sectional, view taken along line C-C in FIG. 6, wherein only the first passage is in communication with the third passage.

As shown in FIG. 10, when the operation rod 22 is rotated to communicate the first passage 2110 with the fourth path 222D, the second passage 2120 is sealed by the fourth pad 222D1 so that the liquid in the first chamber 11 can be sucked out via the second path 222B and the third passage 2130.

It is noted that the two liquids in the first and second chambers 11, 12 are mixed with 1:1 ratio. The shape of the paths can also be wedge-shaped and the embodiment is described hereinafter.

Figure 11:
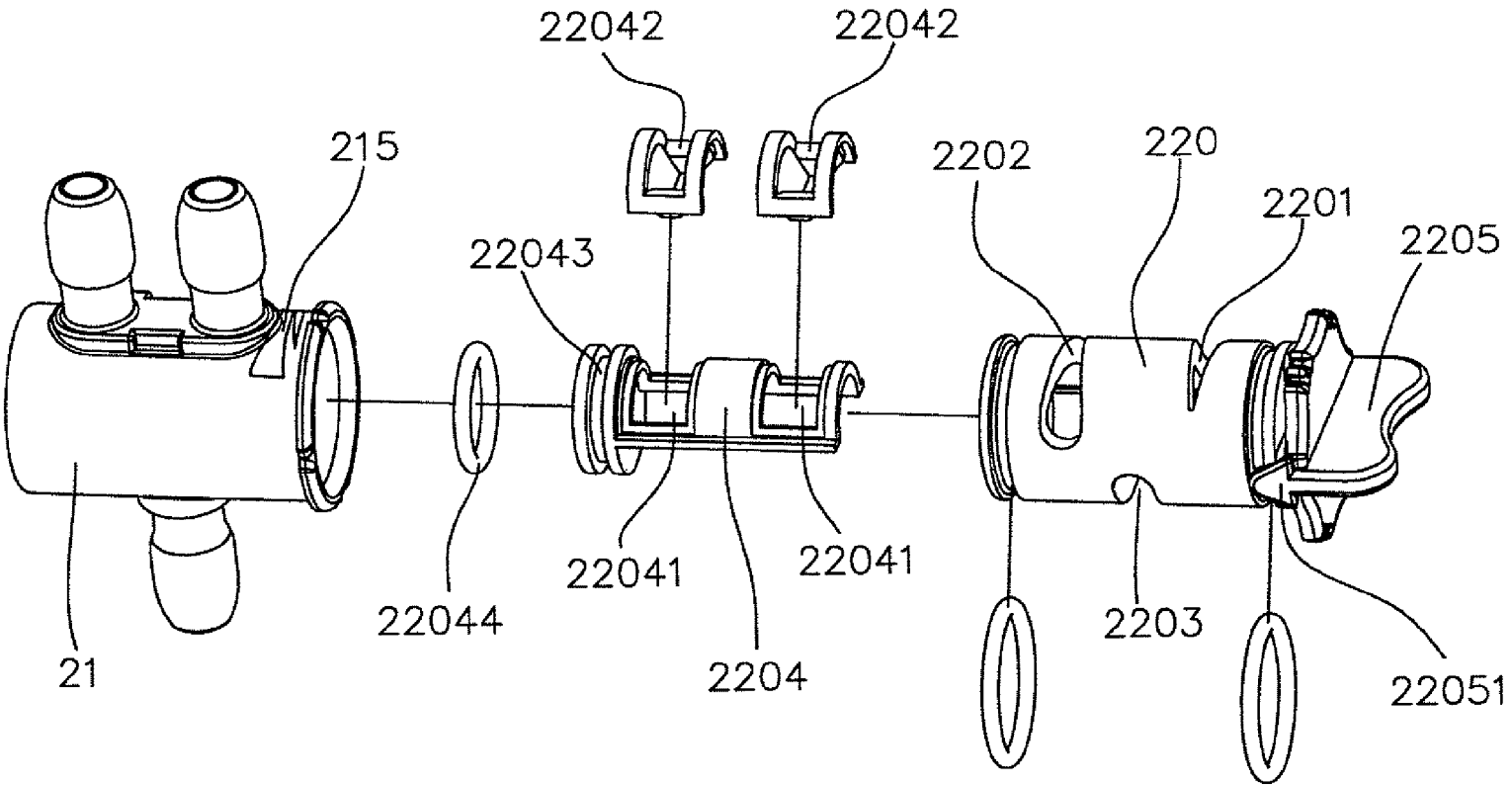
FIG. 11 is an exploded view to show another embodiment of the mixing unit of the present invention.

FIG. 11 shows that the operation rod 220 includes first slot 2201 and a second slot 2202 defined therein, the first and second slots 2201, 2202 are wedge-shaped slots and orientated in opposite directions. A third slot 2203 is defined in the operation rod 220 and located in opposite to the first and second slots 2201, 2202. The third slot 2203 is located corresponding to the third passage 2130 of the body 21. A curved engaging member 2204 has two holes 22041 and two one-direction valves 22042 with two slits 222C2 are engaged with the two holes 22041. A groove 22043 is defined in an end of the engaging member 2204 and a seal ring 22044 is engaged with the groove 22043. The operation rod 220 has a knob 2205 on an end thereof and the knob 2205 has an marker 22051 which extends radially and inward. There index 215 is changed to be wedge-shaped.

Figure 12:
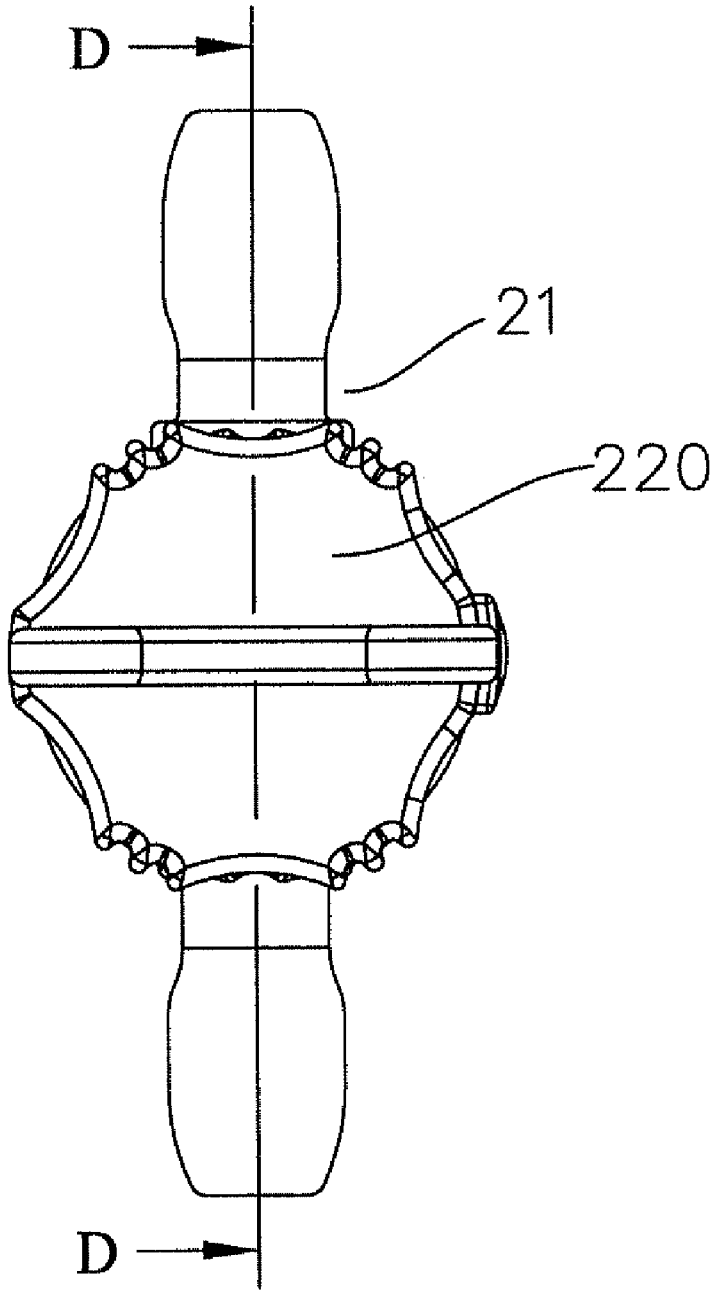
FIG. 12 is a cross sectional view of the mixing unit of the present invention disclosed in FIG. 11.
Figure 13:
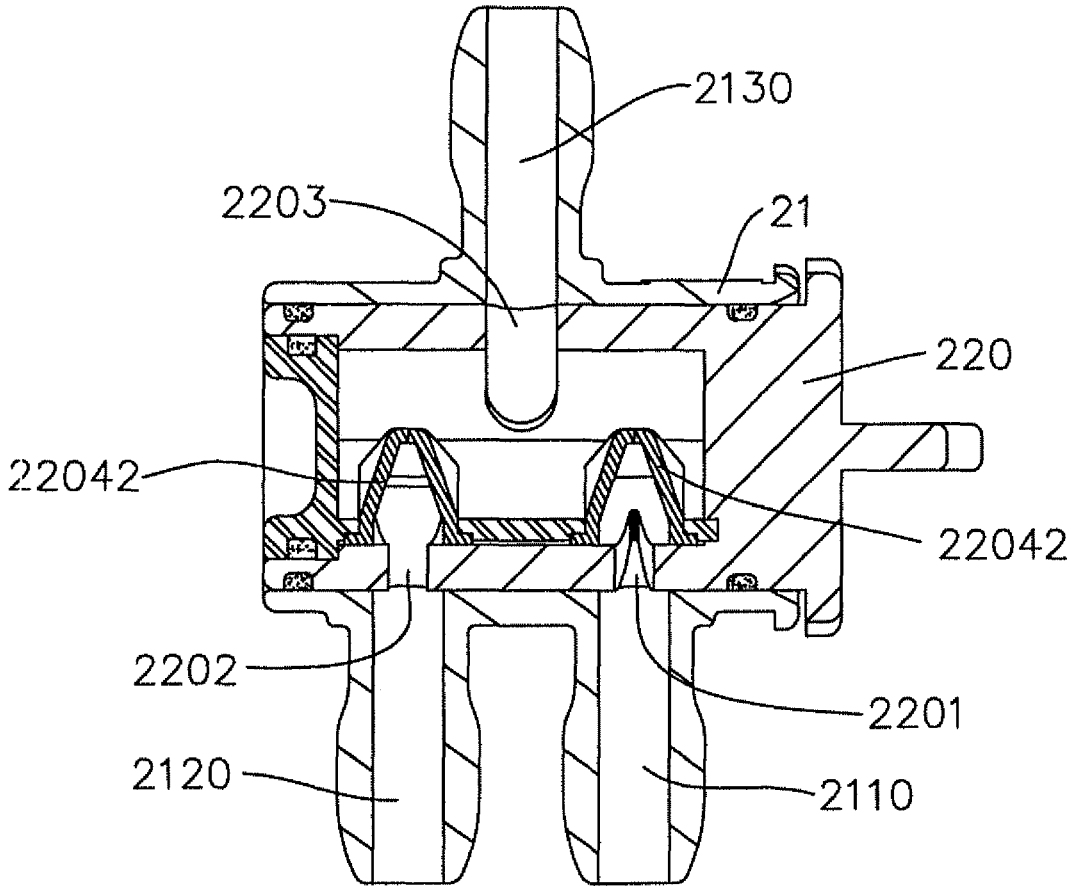
FIG. 13 is a cross sectional view, taken along line D-D of the mixing unit of the present invention disclosed in FIG. 12.

As shown in FIGS. 12 and 13, the engaging member 2204 is received in the operation rod 220 and the first slot 2201 is located corresponding to the first passage 2110. The second slot 2202 is located corresponding to the second passage 2120, and the third slot 2203 is located corresponding to the third passage 2130. When rotating the operation rod 220, the third slot 2203 is kept to communicate with the third passage 2130 all the time, and the first and second slots 2201, 2202 communicate with the first and second passages. 2110, 2120 in opposite proportional change. The valve 22042 with two one-direction valves ensures that the liquids in the bag 1 do not flow reversely.

While we have shown and described the embodiment in accordance with the present invention, it should be clear to those skilled in the art that further embodiments may be made without departing from the scope of the present invention.

What is claimed is:

1. An individual hydration unit comprising:

a bag (1) having a first chamber (11) and a second chamber (12) defined therein, the first chamber (11) having a first outlet (110) connected thereto and the second chamber (12) having a second outlet (120) connected thereto, the first outlet (110) connected with a first hose (111) and the second outlet (120) connected with a second hose (121), a regulator (2) connected to the first and second hoses (111, 121) and a third hose (3) connected to the regulator (2) and located in opposite to the first and second hoses (111, 121), a mouthpiece (4) connected to a distal end of the third hose (3), the regulator (2) having a cylindrical body (21) which has a first passage (2110), a second passage (2120) and a third passage (2130), a restriction ring (214) is connected to an end of the body (21) and two indexes (215) being marked on an outside of the body (21);

an operation rod (22) rotatably inserted in the body (21) and a knob (221) connected to an end of the operation rod (22), a marker (2211) extending inward and radially from the knob (221) and having a hook portion (22111) which is engaged with the restriction ring (214), two first paths (222A), two second paths (222B), a third path (222C) and two fourth paths (222C) defined through the operation rod (22), the first, second, third and fourth paths being in communication with each other, and a connection assembly (23) attached to the body (21) and including a connection piece (231) and a connection member (232), the connection piece (231) having a rectangular protrusion (2313) protruding from a mediate portion thereof, an adjustment slit (2314) defined in the protrusion (2313), the connection member (232) having a rectangular engaging hole (2321) which has an adjustment slot (2322), the protrusion (2313) engaged with the engaging hole (2321).

2. The unit as claimed in claim 1, wherein the first paths (222A) are located corresponding to the third path (222C) and the second paths (222B) are located corresponding to the fourth paths (222D), a third pad (222C1) is engaged with the third path (222C) and having a slit (222C2) defined therethrough, the third pad (222C1) including two openings which are located corresponding to the first and second passages (2110, 2120), the first path (222A) is located corresponding to the third passage (2130);

when the two openings of the third pad (222C1) communicate with the first and second passages (2110) and the first path (222A) communicates with the third passage (2130), two different liquids are served via the third passage (2130);

when the operation rod (22) is rotated 180 degrees from the position where the two openings of the third pad (222C1) communicate with the first and second passages (2110) and the first path (222A) communicates with the third passage (2130), the first, second and third passages (2110, 2120, 2130) are closed;

when one of the second paths (2228) communicates with the second passage (2120) and one of the fourth paths (222D) communicates with the third passage (2130), the other second path (222B) blocks the first passage (2110), liquid in the second chamber (12) is served via the third passage (2130);

when one of the fourth paths (222D) communicates with the first passage (2110) and one of the second paths (222B) communicates with the third passage (2130), the other fourth path (222D) blocks the second passage (2120), the liquid in the first chamber (11) is served via the third passage (2130).

3. The unit as claimed in claim 1, wherein the operation rod (220) includes first slot (2201) and a second slot (2202) defined therein, the first and second slots (2201, 2202) are wedge-shaped slots and orientated in opposite directions, a third slot (2203) is defined in the operation rod (220) and located in opposite to the first and second slots (2201, 2202), the third slot (2203) is located corresponding to the third passage (2130) of the body (21), a curved engaging member (2204) having two holes (22041), two one-direction valves (22042) are engaged with the two holes (22041), a groove (22043) is defined in an end of the engaging member (2204) and a seal ring (22044) is engaged with the groove (22043), the engaging member (2204) is received in the operation rod (220) so that when rotating the operation rod (220), the third slot (2203) communicates with the third passage (2130), the first and second slots (2201, 2202) communicate with the first and second passages (2110, 2120) in opposite proportional change.

4. The unit as claimed in claim 1, wherein the operation rod (22) has a groove (223) defined in an end thereof and a seal ring (2230) is engaged with the groove (223).

* * * * *